US007651248B2

(12) United States Patent
Hua

(10) Patent No.: US 7,651,248 B2
(45) Date of Patent: Jan. 26, 2010

(54) FIRE RESISTANT LIGHTING FITTING

(75) Inventor: Di Hua, Charlton (GB)

(73) Assignee: RD Europe Limited, London (GB)

( * ) Notice: Subject to any disclaimer, the term of this patent is extended or adjusted under 35 U.S.C. 154(b) by 53 days.

(21) Appl. No.: 12/004,210

(22) Filed: Dec. 20, 2007

(65) Prior Publication Data

US 2008/0151561 A1 Jun. 26, 2008

(30) Foreign Application Priority Data

Dec. 22, 2006 (GB) ..... 0625795.0

(51) Int. Cl.
*F21V 29/00* (2006.01)

(52) U.S. Cl. ..... 362/373; 362/294; 362/147

(58) Field of Classification Search ..... 362/365, 362/373, 362, 294
See application file for complete search history.

(56) References Cited

U.S. PATENT DOCUMENTS 4,400,766 A * 8/1983 Munson ..... 362/376
4,658,823 A * 4/1987 Beddoe et al. ..... 607/90
6,286,980 B1 9/2001 Meyer

FOREIGN PATENT DOCUMENTS

GB 2 325 728 A 12/1998
GB 2 422 191 A 7/2006

OTHER PUBLICATIONS

Search Report under Section 17 and 18(3), Patents Act 1977, Application No. GB0625795.0, dated April 26 and 27, 2007.

* cited by examiner

*Primary Examiner*—Ali Alavi
(74) *Attorney, Agent, or Firm*—Amster Rothstein & Ebenstein LLP

(57) ABSTRACT

Provided is a lighting fitting intended to be mounted in a panel. The fitting includes a body in which a lamp may be mounted. The body includes one or more ventilation apertures which are sized and configured to allow heat generated by a lamp in the body to be adequately vented to the exterior of the body, but to inhibit the passage of fire from the interior of the body to the exterior of the body. The one or more ventilation apertures may be formed by a slot in the body. The one or more ventilation apertures may be configured so that when the fitting is installed in its intended orientation, an at least partially downward path is defined between the interior and exterior of the body of the fitting through the aperture.

16 Claims, 2 Drawing Sheets

FIRE RESISTANT LIGHTING FITTING

CROSS-REFERENCE TO RELATED APPLICATIONS

This application claims the benefit of priority under 35 U.S.C. §119 from U.K. Patent Application No. 0625795.0, filed on Dec. 22, 2006 in the U.K. Intellectual Property Office, the contents of which are incorporated by reference.

FIELD OF THE INVENTION

The present invention relates to a fire resistant lighting fitting, and more particularly, although not exclusively, to a fire resistant downlighter.

BACKGROUND OF THE INVENTION

British Standard 476 part 21 requires that lighting installations in ceiling panels do not compromise the integrity of those panels to fire. One way to achieve this is by using a so-called fire resistant fitting. A known fire-resistant downlighter is disclosed in GB 2422191A. This fitting employs a first body of intumescent material disposed in relation to a flange to inhibit passage of fire between a fitting and a ceiling panel in which it is installed and a second body of intumescent material disposed in relation to ventilation holes in the fitting to inhibit passage of fire via those holes. The ventilation holes are provided to allow heat generated by a lamp in the fitting to disperse.

Provision of the second body of intumescent material increases the cost and complexity of manufacture of the fitting. However, if no ventilation were provided the fitting could reach an unacceptably high temperature during use.

The present invention has been made in consideration of the abovementioned problems.

SUMMARY OF THE INVENTION

According to one embodiment of the present invention, there is provided a lighting fitting intended to be mounted in a panel, the fitting including a body in which a lamp may be mounted, the body comprising one or more ventilation apertures, the one or more ventilation apertures being sized and configured to allow heat generated by a lamp in the body to be adequately vented to the exterior of the body but to inhibit the passage of fire from the interior of the body to the exterior of the body.

Provision of suitably sized and configured ventilation apertures obviates the need for the second body of intumescent material of the fitting disclosed in GB 2422191A, simplifying, and reducing the cost of, manufacture.

The one or more ventilation apertures are preferably arranged to inhibit the passage of fire such that installation of the lighting fitting in a panel does not adversely affect the inherent fire resistance of the panel as a consequence of fire being transmitting from the interior of the fitting to its exterior via the one or more ventilation apertures. In this respect the fitting may conform to BS 476 part 21.

Each ventilation aperture may comprise an elongate slot. Each slot is preferably disposed to extend in a substantially horizontal direction when the fitting is installed. Each slot is preferably generally parallel sided. Each slot preferably has a width of less than 3 mm, more preferably less than 2 mm. Each slot preferably has a length of less than 5 cm, more preferably less than 4 cm and still more preferably less than 3 cm.

Each ventilation aperture is preferably formed in a sidewall of the body of the fitting. Each ventilation aperture is preferably configured such that when the fitting is installed in its intended orientation an at least partially downward path is defined between the interior and exterior of the body of the fitting through the aperture. This means that fire would have to travel downward in order to pass out of the body fitting via the ventilation aperture. This is found to effectively inhibit passage of fire through the aperture.

In one embodiment, ventilation apertures are formed in a wall of the body of the fitting by forming a slit in the wall and then deforming the wall to one side of the slit inwardly or outwardly of the body to enlarge the slit and create what will, in use, become an at least partially downward path extending through the slit from the interior to the exterior of the body.

Configuration of the one or more ventilation apertures includes its shape.

Save for the one or more ventilation apertures, and provision to introduce a lamp into the body of the fitting, the remainder of the body is preferably substantially closed.

The lighting fitting may further comprise an inhibitor for inhibiting passage of fire between the fitting and an aperture in a panel in which the fitting is installed. This inhibitor may comprise an intumescent material, in particular an intumescent gasket.

The lighting fitting may be a downlighter.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

Figure 1:
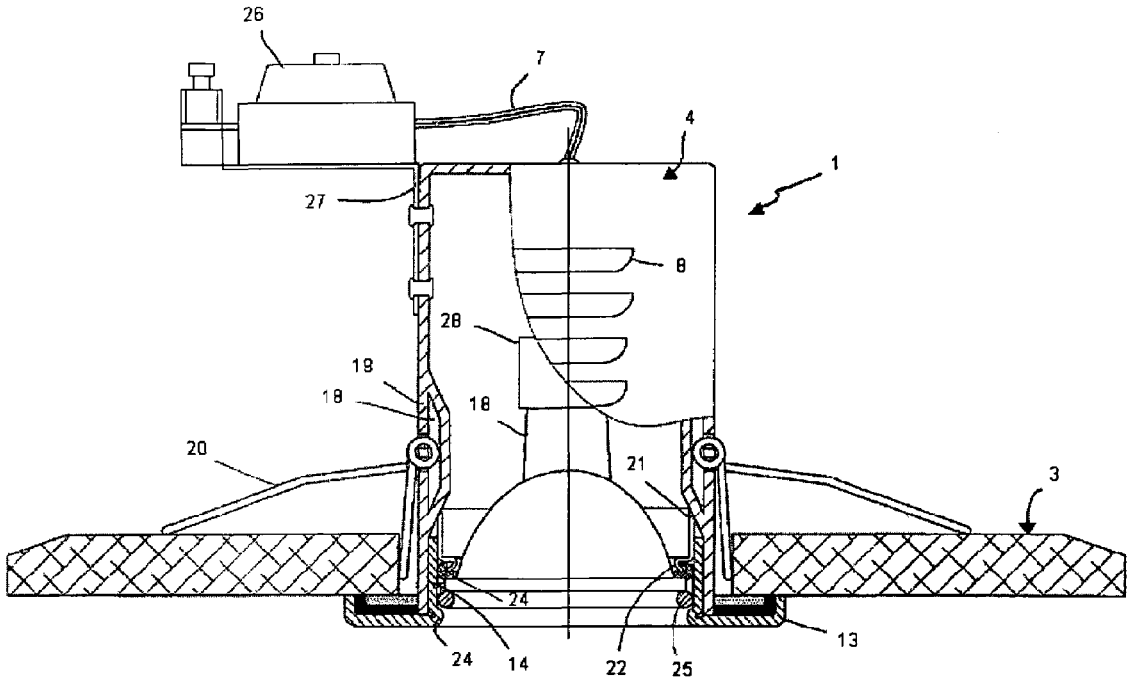
FIG. 1 is a part cross-section front view of a downlighter according to the invention installed in a ceiling panel.
Figure 2:
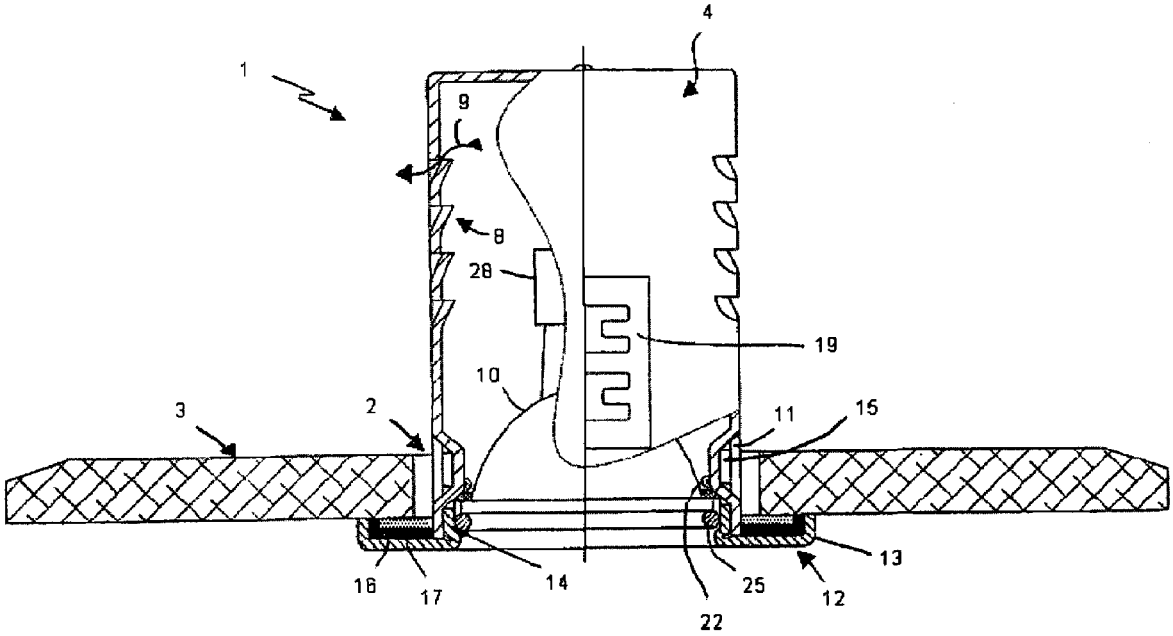
FIG. 2 is a part cross-section side view of the downlighter of FIG. 1.
Figure 3:
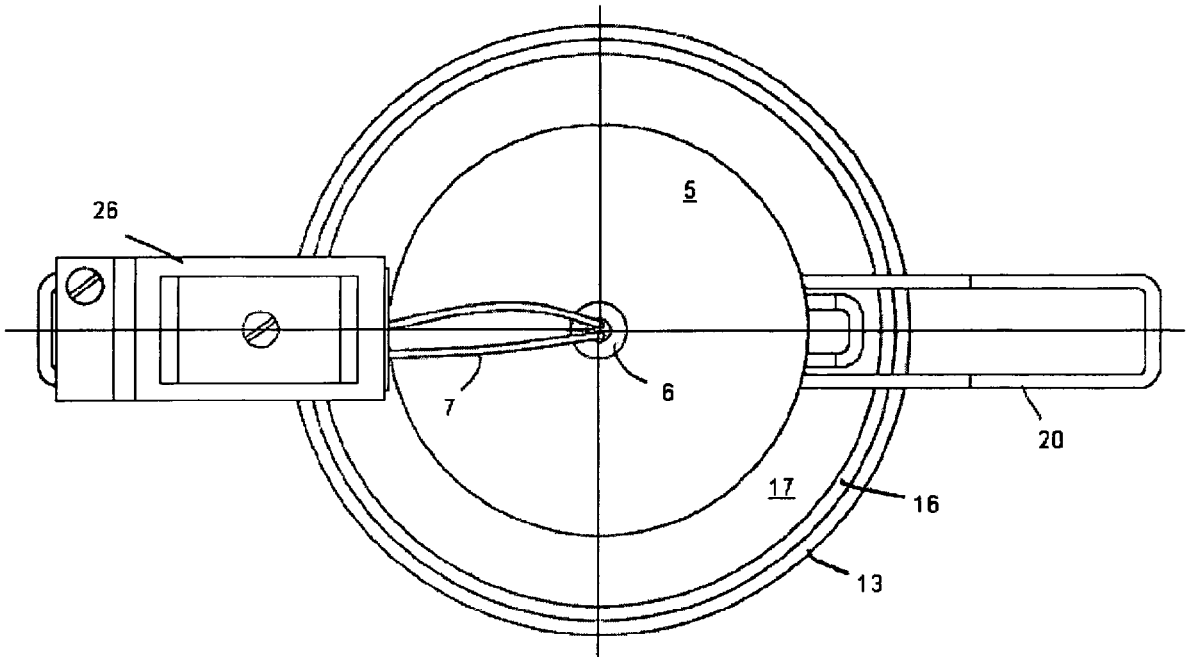
FIG. 3 is a plan view of the downlighter of FIG. 1.

In the following, the terms top, bottom, side and like terms are used for convenience and refer to the downlighter as shown oriented in the drawings, the orientation in which it is intended to be used, and should not be taken as otherwise limiting.

Referring to the drawings, a downlighter, generally 1, is shown installed in an aperture 2 formed in a gypsum ceiling panel 3.

The downlighter 1 comprises a body 4 formed from 1 mm thick steel and powder coated. The body 4 has a generally cylindrical sidewall, the lower end (as shown) of which is open, and the upper end of which is closed to form the top 5 of the downlighter. A small generally circular aperture of about 5 mm in diameter is formed at or near the centre of the top 5 of the body 4. The aperture allows a pair of insulated electrical wires 7 to enter the body and a plastic grommet 6 is fitted into the aperture to prevent the electrical wires 7 being damaged by the cut edge of the steel top 5 of the body 4 which forms the aperture. The size of the aperture is as small as is reasonably practicable.

The cylindrical wall of the body 4 is substantially continuous, save for the provision of two sets of four ventilation slots 8, the two sets being disposed on respective opposite sides of the cylindrical body 4. The slots 8 are provided to allow heat generated by a lamp 10 in the body 4 to disperse, and formed by cutting a slit in the cylindrical wall and deforming the wall below the slit inwards. Consequently, for air or other matter to travel from inside the body 4, to outside the body 4 via one of the slots 8 it must travel downwards through the slot 8, as shown by arrow 9. Each slot 8 extends about 2.5 cm around the circumference of the body 4. The slots 8 are all substantially parallel to each other and those of each set are spaced apart from each other by about 8 mm. The slots 8 are formed towards the upper half of the body 4.

Below each set of ventilation slots 8, towards the bottom of the body 4, the cylindrical wall is downwardly deformed between two pairs of parallel generally vertically extending slits 11. These formations enable a flange fitting 12 to be mounted on the body 4 to provide it with an external flange 13 extending around its open end. The flange fitting 12 comprises a cylindrical portion 14, and the flange 13. The cylindrical portion 14 is sized to fit closely inside the cylindrical wall of the body 4 and comprises two circumferentially extending tongues 15 disposed on opposite sides of the fitting 12 to each other. The tongues 15 are arranged such that when the flange fitting 12 is inserted into the body 4 and then rotated relative to the body 4, the tongues 15 extend through the vertically extending slits 11 passing in front of the inwardly deformed part of the cylindrical wall of the body 4, thereby locking the flange fitting 12 to the body 4.

The flange fitting 12 may be formed from any suitable material, preferably a metal or some other suitably fire resistant material. The lower face of the flange 13 is visible below a ceiling when the downlighter is installed, and so its material may be chosen to have a desired appearance. For example, it can be formed from brass or may be gold or chrome plated or provided with some other decorative finish. As the flange fitting 12 is formed separately to the remainder of the body 4 any chosen design of flange fitting 12 may be provided, as desired, and flange fittings of different appearance may be used with a common design of steel body. This minimizes the amount of potentially relatively costly decorative material required as compared to production of a downlighter body with an integral flange although it will be appreciated that an integral flange could be provided instead.

The flange 13 extends radially outwardly of the cylindrical wall of the body 4, and the free end of the flange 13 turns upwards towards its end. Thus, the flange 13 defines a shallow trough.

Disposed in the flange 13 are two gaskets 16 and 17. Disposed directly on the flange 13 is a silicone rubber gasket 16. The gasket 16 is stepped, with a thicker region at its outer edge and a thinner region at its inner edge. An intumescent gasket 17 is disposed over the thinner, inner, part of the rubber gasket 16. The intumescent gasket 17 comprises cardboard coated on its upper side with an intumescent material, such as expandable granule or powered graphite, or carbon granules.

A lip 24 is formed at the inside of the lower edge of the cylindrical portion 14 of the flange fitting 12, above which is provided a resilient c-clip 25.

Displaced about 90° around the circumference of the cylindrical wall of the body 4 of the downlighter from the ventilation slots 8 are two further recessed portions 18 over which are mounted brackets 19 supporting pivotally mounted spring clips 20 for retaining the downlighter in a ceiling panel 3. These clips 20 are of a known form and therefore need not be described further.

Depending from strips of steel 21 affixed to the inside of the recessed portions 18 of the cylindrical wall of the body 4 is a seal mounting ring 21. This ring 21 provides an outwardly facing substantially circular edge, spaced apart from, but generally parallel to, the inside surface of the cylindrical wall of the body 4. This edge supports a substantially circular flexible seal 23 of U-shaped cross-section with the seal extending into the space between the seal mounting ring 22 and the inside of the cylindrical wall. The seal 23 is formed from silicone rubber, or any other suitable material.

A conventional electrical connector 26 is mounted to the outside of the cylindrical wall by way of a bracket 27 riveted to the cylindrical wall. The electrical wires 7 extend from the connector 26 through the aperture in the top of the downlighter into the downlighter where they are connected to a conventional lamp connector 28.

In use, the downlighter is installed into an aperture in a ceiling panel 3. A substantially circular aperture 2 is formed in the ceiling panel 3 just large enough to accommodate the cylindrical body 4 of the downlighter. The spring clips 20 are pivoted upwards so they lie adjacent the cylindrical body 4 and the body 4 inserted into the aperture 3 from below. This causes part of the spring clips 20 to become trapped between the body 4 and the ceiling panel 3 and the remainder of the spring clips 20 to bear upon the top of the ceiling panel urging the body 4 upwards such that the flange 13 is urged towards the lower surface of the panel 3. This causes the outer, thicker, part of the silicone rubber gasket 16 to be urged against the lower surface of the ceiling panel 3 to form a seal against noise, moisture and other contaminants.

An electrical power supply is connected to the electrical connector 26 in the conventional way.

To install a lamp 10 in the downlighter, the lamp connector 28 is first fitted to the lamp 10. The c-clip 25 is removed from the flange fitting 12 and the lamp 10 is inserted into the body of the downlighter and the c-clip 25 is replaced. The c-clip 25 retains the lamp 10 in the downlighter and urges it against the seal 24 mounted on the seal support ring 23 forming a seal between the lamp 10 and the inside of the cylindrical wall against noise, moisture and other contaminants.

When the lamp 10 is used, heat generated by the lamp 10 within the body 4 of the downlighter disperses via the ventilation slots 8. The powder coating on the body 4 acts to insulate the steel and thereby keep the external temperature of the body 4 lower than it would otherwise be.

In the event of a fire below the ceiling panel 3, the panel's integrity to fire is (at least substantially) not impaired by the presence of the downlighter. If the fire heats the intumescent gasket 17 to a sufficient temperature, the intumescent material will expand, forming an effective fire-resistant seal between the flange 13, the body 4 of the downlighter and the ceiling panel 3. This inhibits passage of smoke and flame between the downlighter 1 and the panel 3.

If fire enters the body of the fitting (whether or not the lamp 10 remains intact), it is prevented from entering the space above the panel 3 via the ventilation apertures 8 by virtue of the size and configuration of the apertures. The ventilation apertures 8 are narrow, and their configuration requires that flame takes a downward path to exit the fitting 12. This is found to significantly restrict passage of flame. The aperture for the wires 7, in the top of the downlighter, is sufficiently small to inhibit any significant passage of flame.

The described fitting confers advantages over existing fire resistant downlighters. The size and configuration of the ventilation slots provides for effective ventilation of the fitting whilst sufficiently inhibiting the passage of fire such that the fitting can meet the requirements of BS 476 part 21. The apertures are formed during manufacture of the fitting. No additional intumescent or other materials are required to prevent passage of fire via ventilation apertures in the fitting. This results in a cost saving.

Provision of the seal mounting ring greatly facilitates installation of the fitting as compared to conventional fittings when a separate seal must be placed over the lamp before it is inserted into the fitting. This separate seal provides an added complication, which may be incorrectly fitted or omitted entirely. This is undesirable.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A lighting fitting intended to be mounted in a panel, the fitting comprising a body in which a lamp is to be mounted, the body comprising one or more ventilation apertures, the one or more ventilation apertures being sized and configured to allow heat generated by a lamp in the body to be adequately vented to the exterior of the body but to inhibit passage of fire from the interior of the body to the exterior of the body.

2. A lighting fitting as claimed in claim 1, wherein the one or more ventilation apertures are arranged to inhibit the passage of fire such that installation of the lighting fitting in a panel does not adversely affect the inherent fire resistance of the panel as a consequence of fire being transmitting from the interior of the body of the fitting to its exterior via the one or more ventilation apertures.

3. A lighting fitting as claimed in claim 1, wherein each ventilation aperture comprises an elongate slot.

4. A lighting fitting as claimed in claim 3, wherein each slot is disposed to extend in a substantially horizontal direction when the fitting is installed.

5. A lighting fitting as claimed in claim 3, wherein each slot is generally parallel sided.

6. A lighting fitting as claimed in claim 3, wherein each slot has a width of less than 3 mm.

7. A lighting fitting as claimed in claim 6, wherein each slot has a width of less than 2 mm.

8. A lighting fitting as claimed in claim 3, wherein each slot has a length of less than 5 mm.

9. A lighting fitting as claimed in claim 8, wherein each slot has a length of less than 3 mm.

10. A lighting fitting as claimed in claim 1, wherein each ventilation aperture is formed in a sidewall of the body of the fitting.

11. A lighting fitting as claimed in claim 1, wherein each ventilation aperture is configured such that when the fitting is installed in its intended orientation, an at least partially downward path is defined between the interior and exterior of the body of the fitting through the aperture.

12. A lighting fitting as claimed in claim 1, wherein the ventilation apertures are formed in a wall of the body of the fitting by forming a slit in the wall and then deforming the wall to one side of the slit inwardly or outwardly of the body to enlarge the slit and create what will, in use, become an at least partially downward path extending through the slit from the interior to the exterior of the body.

13. A lighting fitting as claimed in claim 1, wherein save for the one or more ventilation apertures, and provision to introduce a lamp into the body of the fitting, the remainder of the body is substantially closed.

14. A lighting fitting as claimed in claim 1, further comprising an inhibitor that inhibits passage of fire between the fitting and an aperture in a panel in which the fitting is installed.

15. A lighting fitting as claimed in claim 14, wherein the inhibitor comprises an intumescent material.

16. A lighting fitting as claimed in claim 1, wherein the lighting fitting is a downlighter.

* * * * *